United States Patent [19]

Schiller et al.

[11] Patent Number: 4,606,217

[45] Date of Patent: Aug. 19, 1986

[54] SCREW PRESS HAVING A SHIFTING COUPLING AND A CONTINUOUSLY ROTATING FLYWHEEL

[75] Inventors: Werner Schiller, Leverkusen; Manfred Benedix, Leichlingen; János Szákacsi, Bergisch-Gladbach, all of Fed. Rep. of Germany

[73] Assignee: Eumuco Aktiengesellschaft für Maschinenbau, Leverkusen, Fed. Rep. of Germany

[21] Appl. No.: 681,761

[22] Filed: Dec. 14, 1984

[30] Foreign Application Priority Data

Dec. 22, 1983 [DE] Fed. Rep. of Germany ..... 3346329

[51] Int. Cl.[4] ..... B21J 9/18

[52] U.S. Cl. ..... 72/454; 72/30; 72/444; 100/289

[58] Field of Search ..... 72/454, 21, 26, 30, 72/444; 100/289; 192/103 C, 0.077, 101; 83/631

[56] References Cited

U.S. PATENT DOCUMENTS 4,207,763 6/1980 Huydts et al. ..... 72/454

FOREIGN PATENT DOCUMENTS 2643534 3/1978 Fed. Rep. of Germany ..... 100/289
2837253 5/1979 Fed. Rep. of Germany ..... 72/454
3102665 8/1982 Fed. Rep. of Germany ..... 100/289

*Primary Examiner*—Francis S. Husar
*Assistant Examiner*—David B. Jones
*Attorney, Agent, or Firm*—Neil F. Markva

[57] ABSTRACT

The invention is a shifting mechanism for a screw press. The screw press includes a shifting coupling for the press spindle, a drive mechanism for continuously rotating a flywheel, a coupling mechanism operatively located between the flywheel and the shifting mechanism which is dependent upon angular deceleration and is controlled for the purpose of actuating the coupling mechanism. The shifting mechanism comprises a hydraulically actuatable shifting coupling. A hydraulically prestressed valve is located between the reaction mass and a rotating coupling portion that is connected to the flywheel. The coupling mechanism is controlled through the use of a hydraulic line and the prestressed valve is affected by the hydraulic pressure medium in that line acting upon the coupling mechanism.

22 Claims, 3 Drawing Figures

SCREW PRESS HAVING A SHIFTING COUPLING AND A CONTINUOUSLY ROTATING FLYWHEEL

FIELD OF THE INVENTION

The invention relates to a screw press having a shifting coupling for the press spindle and a driven flywheel rotating continuously, a coupling arranged between the flywheel and a spindle disk and a reaction mass which is coupled with the flywheel. More particularly, such a screw press includes a shifting mechanism dependent upon angular deceleration and controlled for the purpose of actuating the coupling.

BACKGROUND OF THE INVENTION

Drop forging under screw presses requires a comparatively large amount of energy and therewith a heavy flywheel. To protect the press from inadmissable overstressing because of a rebound blow, it is known to couple the press spindle using a spring-loaded slipping coupling. Surplus energy is then eliminated through friction work in the slipping coupling.

The control device described in German Patent Specification No. 28 37 253 utilizes the slipping at the time of the blow of the screw press. Such slipping develops in the coupling as the coupling torque is exceeded, that is, the resultant relative motion between flywheel and spindle, in order to shift the coupling. In this known structure, a control lug is in the form of an oblong swivel lug and comes into contact with the peripheral surface of the coupling portion fixed with respect to the spindle. Such contact comes when the coupling portion and the flywheel run synchronously while pressure medium acts upon the respective associated piston.

Slipping of the coupling portions sets in under load when the speed of the coupling portion on the side of the spindle is reduced with respect to the speed of the flywheel. When such slipping occurs in this known structure, the control lug swings out of the engaged position so that the piston of the control lug is pushed further in the direction of the center of the press. The control lug moves under the working pressure of the pressure medium present in the first instance. Upon control lug movement there is a rapid fall in pressure in the cylinder chambers and in the coupling pressure chamber connected therewith. Consequently, uncoupling takes place due to the coupling return-springs. The action of the pressure medium follows pneumatically.

In the case of controlled reactions of this kind, it follows that the throwout of the coupling is only initiated at that point in time at which the transferable torque has already been exceeded. Before the reaction of the coupling for the reduction of the torque, more time passes in which necessary friction is carried out thereby resulting in wear and heating with a deterioration in the level of efficiency. Basically, it is too late to shift only when the coupling is overloaded.

Other known shifting mechanisms are dependent upon angular deceleration and utilize the inertia forces of reaction masses arranged on the spindle. German Patent Specification No. 28 01 139 discloses a screw press equipped with a pneumatically operated coupling having a pneumatic rapid vent valve. When a disk is assigned to the spindle as a movable mass, the disk moves as a result of the deceleration of the spindle at the time of the press blow. Such disk movement is affected by a toothed surface axially to the spindle and causes therewith rapid venting of the coupling via anticipatory and main control. Use of compressed air is disadvantageous because it requires a comparatively long expansion time. Indeed, if the coupling is adjusted with different levels of air pressure to achieve different torques and therewith different powers of impact, the shifting member, which functions with inertia, is excluded from this adjustability and only reacts when angular deceleration of the spindle is constant at all times.

The screw press described in German Patent Specification No. 26 43 534 includes a shifting mechanism that is dependent upon angular deceleration and utilizes the inertia forces of the reaction masses arranged on the flywheel. This coupling device has a spring link joint which is dependent upon the speed of the work spindle which comes into operation when a given pressing action is achieved and which is developed as a quick-break shifter. A control disk flywheel as a reaction mass exerts a force upon the spring link joint, whereby the work spindle is uncoupled from the flywheel. In this known construction, reaction movements which are much too great are required at the control mechanism for the actuation of a coupling. Thus, the reaction time is clearly prolonged and this is detrimental to the whole shifting process.

SUMMARY OF THE INVENTION

The invention relates to a shifting mechanism that is dependent upon angular deceleration and has a coupling which may be shifted by reaction masses rotating with the flywheel. The shifting mechanism of this invention is dependent upon angular deceleration but responds sharply and such response may take place before the coupling sliding sets in thereby controlling the coupling at the correct time.

According to the invention described herein, there is a unique shifting mechanism used with the kind of screw press described hereinabove having a reaction mass. Such shifting mechanism has a shifting coupling which may be actuated hydraulically. A valve is arranged between the coupling portion rotating with the flywheel and the reaction mass and is prestressed hydraulically. Such prestressed valve is affected by the pressure medium acting upon the coupling portion.

With a hydraulically actuated shifting coupling, the hydraulic medium has essentially less compressability than does air. The shift areas and shift volumes are also essentially reduced by a pressure which may be obtained at a higher level. The pressure suppression in the coupling and thus the reduction of the transferable torque may be effected most quickly. This is important because of the wear on the coupling, the heating of the coupling and even the energy efficiency.

The introduction of pressure suppression can still take place before the start of the slipping process. This is particularly important while the increase in power, which still follows, is effected supporting the decreasing torque via the masses which are not protected by fuse. This does indeed take place even with known screw presses. However, with these machines, the dimensioning of the coupling disk as an essential carrier of energy of the masses which are not protected by fuse must be kept as low as possible in terms of energy. This is due to the prolonged slip of the coupling and the torque which lasts therewith for a prolonged period of time (until the spindle stops).

Pressure suppression takes place essentially more quickly with the subject matter of this invention. Thus, the dimensioning of the masses which are not protected by fuse, more particularly of the coupling disk, can be effected in such a way that, on the one hand, a defined increase in power can take place and that, on the other hand, rebound blow safety and therewith overload safety are guaranteed. The effective areas of the prestressed valve can be brought into such a relationship with each other for the mass action of the reaction mass in consideration of the coupling torque that the prestressed valve responds before the coupling slipping takes place.

At the time of the start of the slip which follows, a reaction has already taken place with regard to the opening of the coupling as pressure suppression in the pressure medium chamber of the coupling was initiated before the start of the slip. With the torque which is reducing, on the one hand, and with the mass (coupling disk, spindle, ramming tool) which is not protected by fuse and which is located behind the coupling, on the other hand, further buildup of power takes place until final power is reached.

According to a further feature of the invention, the reaction mass as a ring disk and the coupling portion each have at least one radial projection. The spring-loaded prestressed valve is arranged between such radial projections. In this specific embodiment, the prestressed valve is inserted into the outlet line of the hydraulic pressure medium. Such an arrangement is of significant importance. That is, when varying the power of impact of the press by acting upon the coupling with pressure in a different way (different coupling torque), even the mechanism for opening the coupling is adapted to suit this adjustment in terms of the power of impact. Pressure suppression in the coupling is initiated before the start of the slip irrespective of the adjusted power of the press blow (torque), that is, under the same operating conditions. The shift mass and the prestressed valve affected by the mass are located outside the coupling. That is, they are in an area which is easily accessable. Thus, the scope for maintenance is improved.

According to another feature of the invention, the prestressed valve has a piston slidingly mounted on the valve shaft. An abutment is fixedly secured on the valve shaft between a first and second spring. The first spring acts directly on the piston. Furthermore, a restrictor connects the pressure chamber of the prestressed valve with the cylinder chamber of the piston. The diameter of the cylinder chamber is smaller than the diameter of the valve cone or body and greater than the diameter of the valve shaft. Such prestressed valve construction makes it possible for, on the one hand, reliable closing at the start of the stroke of the press (pressure buildup in the coupling) and, on the other hand, faster opening of the valve when the latter is actuated.

Furthermore, according to the invention, an annular channel is arranged in the pressure medium return line. In the specific embodiment, the channel comprises a U-shaped annular collar disposed on the press headpiece. An annular countercollar is disposed on the rotating coupling portion and acts together with the collar to form a seal. As the annular channel diverts the relieved pressure medium, the outflow of the pressure medium after the valve is assisted by the centrifugal force affected by the rotating coupling. It would be disadvantageous to discharge the relieved pressure medium via a concentric swing joint, as a certain impact pressure can form in the discharging line and thereby delaying the discharge.

A control valve and a shift valve is arranged in the hydraulic pressure medium supply line leading to the shifting coupling and a check valve is arranged in the by-pass to the shift valve. Moreover, the prestressed valve is connected to the hydraulic return line.

BRIEF DESCRIPTION OF DRAWINGS

Other objects of this invention will appear in the following description and claims, reference being made to the accompanying drawings forming a part of the specification wherein like reference characters designate corresponding parts in the several views.

DETAILED DESCRIPTION

Figure 1:
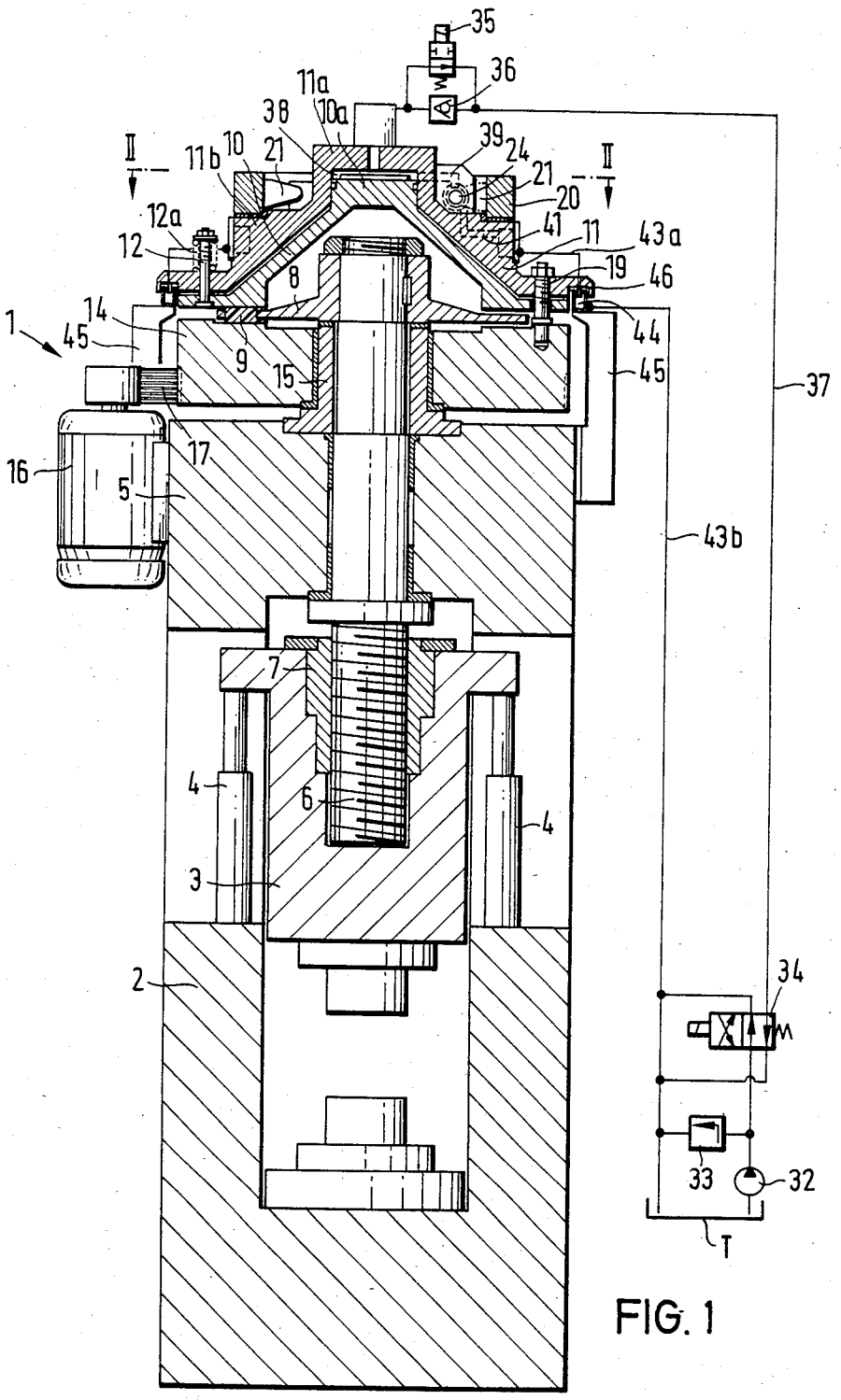
FIG. 1 is a longitudinal sectional view of a screw press made in accordance with the invention.

The screw press, generally designated 1, includes a support base 2, a ramming tool 3 having ramming return traverses 4, and a headpiece 5. A rotatable spindle 6 is disposed in headpiece 5 and is not able to move in the axial direction. The spindle nut 7 is arranged in the ramming tool 3. A coupling disk 8 is connected to spindle 6 in a manner secure against rotation and receives friction blocks 9 which are distributed along the periphery of disk 8 in pockets provided therefor. A coupling member 10 may be adjusted axially and has a bulb-shaped portion 10*a* which slides in a cylinder 11*a* of a coupling portion 11 and which can be acted upon hydraulically. After relief of the pressure medium, coupling member 10 can be moved back by spring return traverses 12*a* on the supporting bolt 12, whereby the form of frictional closure is removed.

A flywheel 14 is rotatably mounted on a bearing 15 disposed in headpiece 5. Motor 16 rotates flywheel 14 constantly in a direction of rotation via V-belts 17 or the like.

Figure 2:
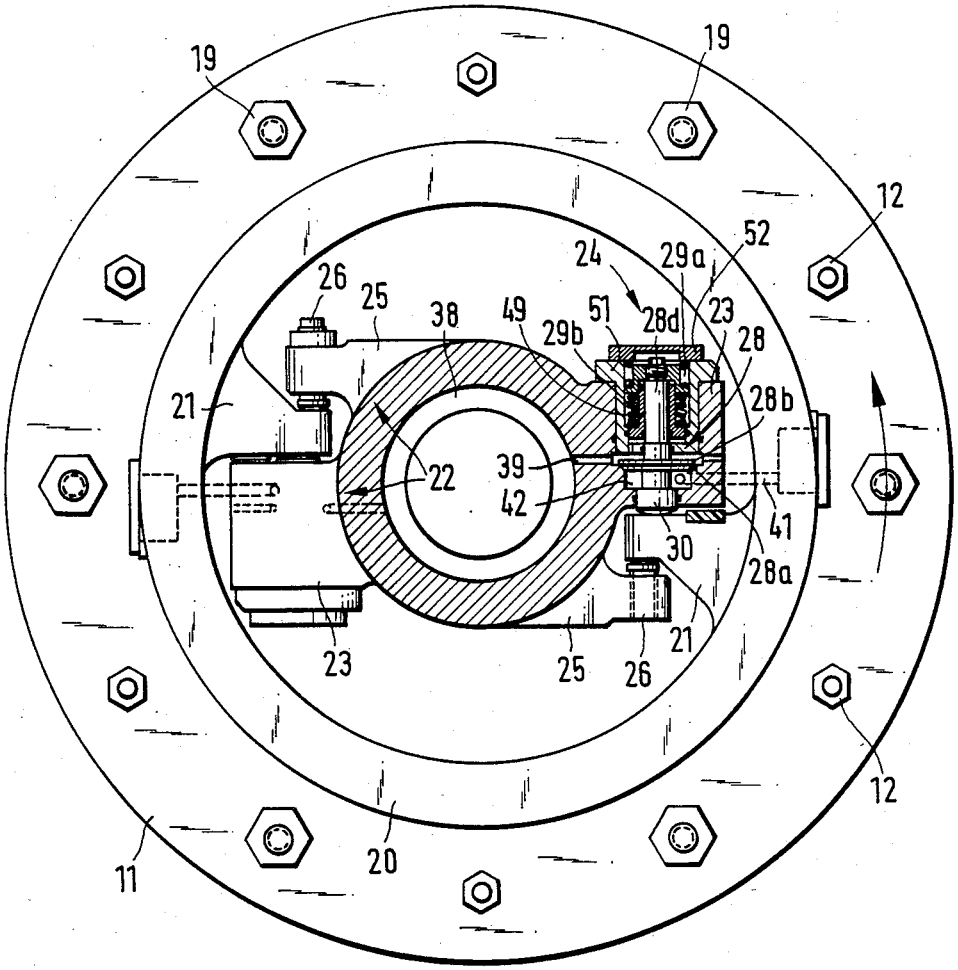
FIG. 2 is a view taken along II—II of FIG. 1.
Figure 3:
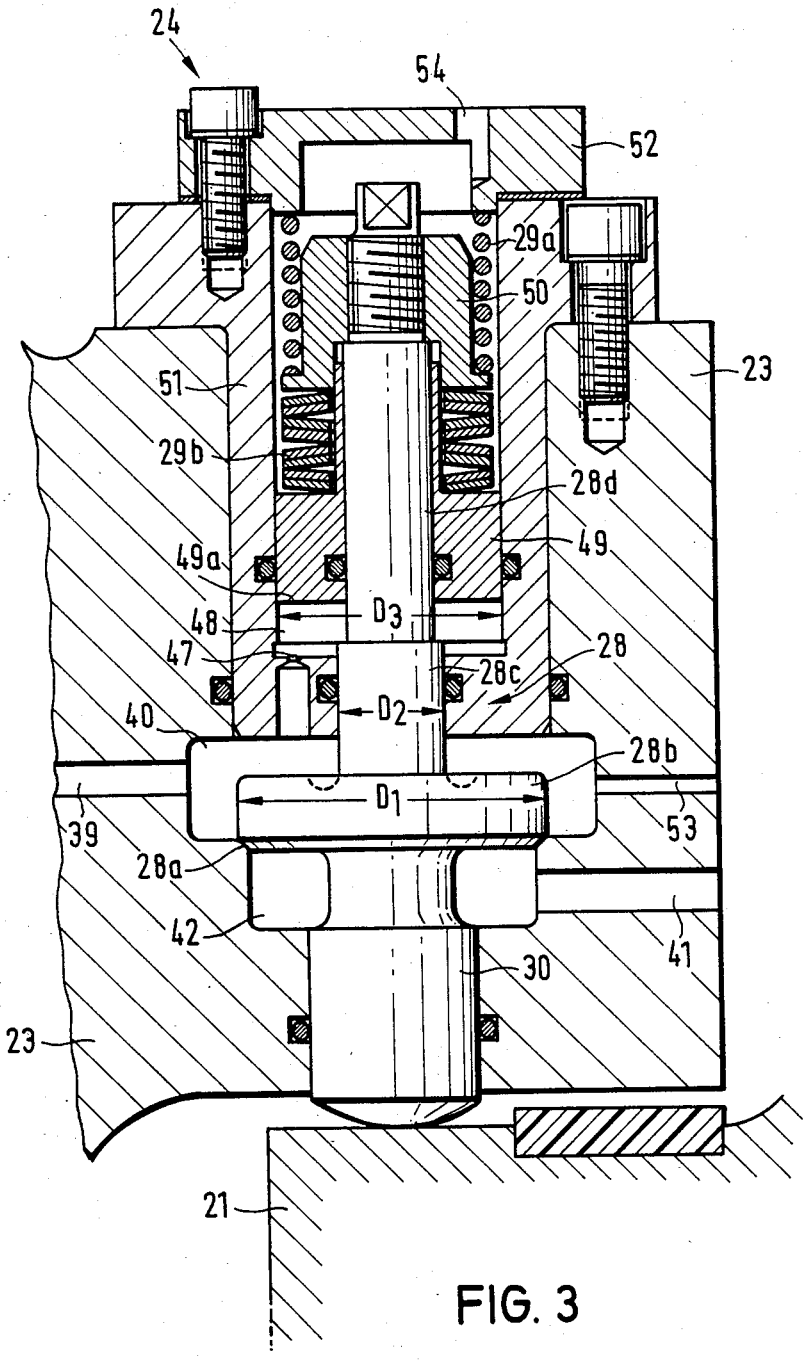
FIG. 3 is an enlarged sectional view through the prestressed valve used in combination with the screw press of FIG. 1.

In this embodiment, coupling portion 11 is formed as a hood and connected with flywheel 14 by screws 19 in a manner secure against rotation. Reaction mass 20 is in the form of a ring disk and is mounted on shoulder 11*b* of coupling portion 11 in such a manner that it may be rotated. Ring disk 20 has a projection 21 pointing inwardly. Coupling portion 11 or cylinder 11*a* has a projection 22 which points outwardly radially and is formed so that it is forked in this specific embodiment. The fork side 23 receives a hydraulically prestressed valve 24 as shown in FIG. 3. The other fork side 25 has an adjusting screw 26 for constricting the movement of the projection 21 of ring disk 20. The same arrangement with a correspondingly constructed prestressed valve 24 is provided on the diametrical side of coupling portion 11 as shown in FIG. 2.

The hydraulic system for the screw press of this invention includes a pump 32 acting as a hydraulic power station. The pressure generation of pump 32 is adjustable by pressure relief valve 33. Control valve 34, shift valve 35, check valve 36 and a pressure line 37 are used to control the flow of hydraulic fluid in the system. Check valve 36 and control valve 34 serve auxilliary purposes such as for the setting up operation of press 1. Hydraulic line 39 leads from pressure chamber 38 above piston 10*a* of coupling member 10 to pressure chamber 40 of prestressed valve 24.

A further hydraulic line 41 leads from chamber 42 behind the valve seat to return lines 43*a*, 43*b* of the hydraulic system by a U-shaped collar 44 which is secured to supports 45 of headpiece 5. Collar 44 which has a U-shaped cross section is sealed to the rotating coupling portion 11 by a countercollar 46.

Prestressed valve 24 includes a valve body 28*b* having a bearing surface 28*a* and a shaft having shaft portions 28*c* and 28*d*. A piston 49 is slidingly mounted on shaft portion 28*d*. Spring 29*b* acts upon piston 49 as shown. An abutment 50 is secured to shaft 28*d* and disposed between spring 29*b* and a further spring 29*a*. The whole assembly of piston 49, springs 29*a*, 29*b*, abutment 50 and shaft portions 28*c* and 28*d* is housed in cylinder 51 which is kept shut by cover 52. Inlet bore 53 serves to fill pressure chambers with hydraulic pressure fluid medium. The bore 54 carries off the leakage oil at the outer end of the shaft portion 28*d*. Valve plunger 28 includes a guiding portion 30 slidingly mounted within the fork side 23 as shown.

A restrictor 47 is formed as a choke bore in this embodiment and connects pressure chamber 40 of prestressed valve 24 to cylinder chamber 48 of piston 49. In this arrangement, diameter $D_3$ of cylinder chamber 48 is smaller than the diameter $D_1$ of valve cone or body 28*b* and greater than $D_2$ of valve shaft portion 28*c*.

Prestressed valve 24 is subject to the same mean working pressure as coupling portion 11 during the working stroke. After prestressed valve 24 has been shifted, the pressure medium is relieved via chamber 42 and line 41. To guarantee that the prestressed valve 24 remains closed even when engaging, a power surplus is obtained to keep the valve shut by connecting pressure chamber 40 with a cylinder chamber 48, which is under initial tension of spring 29*b*, via choke bore 47. Cylinder chamber 48 is under initial tension of spring 29*b* and is filled with a delay as a result of the choking effect at bore 47 so that the circular ring effective area of prestressed valve $D_1$–$D_2$ takes effect as long as there is no pressure compensation in chambers 40 and 48. With this, prestressed valve 24 is definitely kept shut during the switching-on phase of screw press 1 (pressure build-up in the coupling) in which negligible delay effects and therewith dynamic effects of the reaction mass act on said prestressed valve 24.

After pressure compensation in chambers 40 and 48, the circular ring effective areas $D_1$–$D_3$ takes effect. This effective area produces with the associated pressure the counterforce (equilibrium) to the support effect of the annular reaction mass during the pressing process.

Choke bore 47 and pressure chamber 48 additionally produce a second effect when acted upon by spring 29*b*. When the equilibrium of the force of the reaction mass against the closing force of valve 24 is exceeded, valve 24 opens by way of valve seat 28*a* whereby the pressure in the coupling is relieved abruptly through the lines 41 and 43 leading to the reservoir tank T. The pressure present in pressure chamber 48 is relieved because of choke bore 47 but such relief takes place more slowly than the decrease in pressure in pressure chamber 40. The surface of piston 49 takes effect hereby as well and thus contributes to the accelerated (jump-type) opening of valve 24.

In the peripheral direction or in the direction of the delay effect at the time of the press blow, the shift mass 20 is supported against the hydraulically prestressed valve 24. In this case, the hydraulic prestressing pressure of valve 24 corresponds to the hydraulic coupling pressure. When ramming tool 3 is in its upper position, it is secured by a brake (not shown) and is supported in the upper position by return traverses 4. Electric motor 16 rotates flywheel 14 in a direction of rotation at a rated speed. The desired power of the blow can be preselected with the aid of valve 33 before triggering the stroke of the machine.

After operating valve 35, the pressure medium acts on the coupling and therewith also on prestressed valve 24 whereby coupling member 10 is engaged. Because of the small masses to be advanced, ramming tool 3 takes on its rated speed at shortened notice and is made to descend downwardly. The deformation process is initiated with the touch-down of the swage or ram upon the workpiece. This results in an increase in power and an output of energy from flywheel 14. This power output from flywheel 14 takes place with speed reduction when there is corresponding deceleration of flywheel 14. The shift mass 20 on account of its mass moment of inertia is hereby supported so much the more at the prestressed valve 24 the greater the required forming force and therewith the angular deceleration of the flywheel 14 become. When the state of equilibrium in the prestressed valve 24 is exceeded (support effect of the shift mass 20 against force from hydraulic pressure), valve 24 opens abruptly and pressure chamber 38 of the shifting coupling is relieved immediately over the pressure medium channel 39, 41, and 43 with the torque of the coupling reducing as quickly as possible.

Pressure suppression in the pressure medium chamber 38 of coupling 8, 10 is initiated before the start of the slip. The effective areas of prestressed valve 24 have such a relationship for the mass action of shifting mass 20 in consideration of the coupling torque that the prestressed valve 24 responds before the coupling slipping takes place. The masses found behind the coupling, such as the coupling disk 8, spindle 6, ramming tool 3 bring about the further build-up of power until final power is reached when the torque is reducing.

While the screw press having a shifting coupling and a continuously rotating flywheel has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. In a screw press including a shifting coupling for the press spindle having a spindle disk, means for continuously rotating a flywheel, coupling means operatively located between the flywheel and the spindle disk, a reaction mass coupled with the flywheel and a shifting mechanism dependent upon angular deceleration and controlled for the purpose of actuating the coupling means, the shifting mechanism comprising:

(a) a hydraulically actuatable coupling means, (b) a hydraulically prestressed valve located between the reaction mass and a rotating coupling portion connected to the flywheel, and (c) means for hydraulically operating on the coupling means, (d) said prestressed valve being affected by the hydraulic pressure medium acting upon the coupling means, (e) the reaction mass comprises a ring disk, (f) the ring disk and the coupling portion each have at least one radial projection extending toward each other, the prestressed valve is spring-loaded and located between said projections, and (g) the prestressed valve is inserted in the outlet line of the hydraulic pressure medium for the shifting coupling means.

2. In a screw press as defined in claim 1 wherein the radial projection of the coupling portion comprises a forked structure having two sides which encompass the projection extending from the reaction mass ring disk.

3. In a screw press as defined in claim 2 wherein the prestressed valve is disposed in one side of the forked structure of the coupling portion, and an adjusting screw is disposed in the other side of the forked structure and acts upon the projection extending from the reaction mass ring disk.

4. In a screw press as defined in claim 1 wherein the coupling portion comprises a hood member having an annular shoulder disposed on the outside thereof, and the ring disk is mounted on said annular shoulder of said coupling hood member.

5. In a screw press including a shifting coupling for the press spindle having a spindle disk, means for continuously rotating a flywheel, coupling means operatively located between the flywheel and the spindle disk, a reaction mass coupled with the flywheel and a shifting mechanism dependent upon angular deceleration and controlled for the purpose of actuating the coupling means, the shifting mechanism comprising:

(a) a hydraulically actuatable coupling means, (b) a hydraulically prestressed valve located between the reaction mass and a rotating coupling portion connected to the flywheel, and (c) means for hydraulically operating on the coupling means, (d) said prestressed valve being affected by the hydraulic pressure medium acting upon the coupling means, (e) the prestressed valve includes a cone, a shaft and a piston slidingly mounted on the shaft of the valve cone, (f) an abutment is secured to the shaft between a first and second spring, (g) the first spring acts directly on the piston, (h) the prestressed valve includes a pressure chamber, a restrictor and a cylinder chamber, (i) the restrictor connects the cylinder chamber of the piston to the valve pressure chamber.

6. In a screw press as defined in claim 5 wherein the cylinder chamber has a diameter smaller than the valve cone diameter and greater than the valve shaft diameter.

7. In a screw press as defined in claim 5 wherein the prestressed valve has a pressureless side and the prestressed valve shaft includes a guiding portion located on said pressureless side.

8. In a screw press including a shifting coupling for the press spindle having a spindle disk, means for continuously rotating a flywheel, coupling means operatively located between the flywheel and the spindle disk, a reaction mass coupled with the flywheel and a shifting mechanism dependent upon angular deceleration and controlled for the purpose of actuating the coupling means, the shifting mechanism comprising:

(a) a hydraulically actuata ble coupling means, (b) a hydraulically prestressed valve located between the reaction mass and a rotating coupling portion connected to the flywheel, and (c) means for hydraulically operating on the coupling means, (d) said prestressed valve being affected by the hydraulic pressure medium acting upon the coupling means, (e) there is a return line for the pressure medium which hydraulically operates the shifting mechanism, (f) said return line includes an annular channel for the pressure medium, (g) the annular channel comprises a U-shaped annular collar disposed on the press headpiece, and (h) an annular countercollar is disposed on the rotating coupling portion and acts to form a seal with the U-shaped annular collar.

9. A screw press comprising:

(a) a flywheel drivable continuously in the same direction of rotation around a spindle, (b) coupling means operatively located between the flywheel and the spindle, (c) hydraulic control means for establishing a connection between the flywheel and the spindle only during a working stroke of the screw press, (d) a reaction mass connected for rotating with the flywheel to serve as a reaction and shifting mass, (e) upon an angle deceleration of the flywheel caused by the operation of the screw press, the reaction mass following its inertia forces moves in advance of the flywheel to cause a relief of the coupling means, (f) control means dependent upon angular deceleration is located between the flywheel and the reaction mass, (g) the coupling means including a coupling portion connected to the flywheel and carrying the reaction mass directly thereon, (h) said hydraulic control means including a pressure medium and a valve hydraulically prestressed in a discharge line of the pressure medium by the pressure existing in the coupling means, (i) the valve being located between radial projections located on the reaction mass and the coupling portion, and (j) the prestressed valve including effective surfaces, and in view of the action of the reaction mass and considering the coupling torque, said effective surfaces are in such a relationship that the response of the prestressed valve is taking place before the slipping of the coupling means begins.

10. A screw press as defined in claim 9 wherein the prestressed valve contains a valve body and a shaft, the valve body has a seat surface and the shaft has shaft elements being each of a diameter less than the diameter of the valve body.

11. A screw press as defined in claim 10 wherein the valve body and a shaft portion are disposed in respective cylinder chambers of different sizes, and the diameter of the cylinder chamber for the shaft portion is smaller than the diameter of the valve body and greater than the diameter of the valve shaft.

12. A screw press as defined in claim 9 wherein the valve-includes a piston in a cylinder chamber and a pressure chamber, the pressure chamber being connected with the cylinder chamber of the piston through a restrictor opening.

13. A screw press as defined in claim 9 wherein the prestressed valve includes a piston and a valve cone with a shaft, the piston is slidingly mounted on the shaft of the valve cone, an abutment member is secured to said shaft and arranged between a first spring acting directly on the piston and a second spring.

14. A screw press as defined in claim 9 wherein the reaction mass is an annular disk, the flywheel is nonrotatingly connected to the coupling portion, the annular disk includes at least one radial projection and the coupling portion includes a radially oppositely directed projection which receives the prestressed valve that adjoins the projection of the annular disk oppositely to the direction of rotation of the coupling portion.

15. A screw press as defined in claim 9 wherein the prestressed valve includes a shaft having a pressureless side that is provided with a guiding portion.

16. A screw press as defined in claim 9 wherein the radial projection of the coupling portion is fork-shaped including fork legs which encompass the projection of the annular disk.

17. A screw press as defined in claim 16 wherein the prestressed valve is located in one fork leg of the coupling portion and an adjusting screw is mounted in the other fork leg thereof.

18. A screw press as defined in claim 9 wherein the coupling portion is hood-shaped, and the reaction mass is an annular disk positioned on an annular shoulder of the coupling portion.

19. A screw press as defined in claim 9 wherein the coupling means includes an axially adjustable coupling member with a piston shaped portion slidingly supported in a coupling portion.

20. A screw press as defined in claim 9 wherein the control means includes a control valve and a shift valve located in the pressure medium supply line leading to the shifting coupling portion and a check valve is arranged in a by-pass to the shift valve.

21. A screw press as defined in claim 9 wherein there is a return line for the pressure medium and an annular channel is disposed in the return line for the pressure medium.

22. A screw press as defined in claim 21 wherein the annular channel is formed by a U-shaped annular collar disposed on a screw press headpiece and coacting sealingly with an annular countercollar disposed on the rotating coupling portion.

* * * * *